US005094660A

United States Patent [19]

Okuzawa

[11] Patent Number: 5,094,660

[45] Date of Patent: Mar. 10, 1992

[54] IMAGE RECORDING APPARATUS

[75] Inventor: Tugio Okuzawa, Kanagawa, Japan

[73] Assignee: Fuji Photo Film Co., Ltd., Kanagawa, Japan

[21] Appl. No.: 634,828

[22] Filed: Jan. 2, 1991

Related U.S. Application Data

[63] Continuation of Ser. No. 366,381, Jun. 15, 1989, abandoned.

[30] Foreign Application Priority Data

| | | | |
|---|---|---|---|
| Jun. 15, 1988 | [JP] | Japan | 63-147844 |
| Aug. 25, 1988 | [JP] | Japan | 63-211185 |
| Aug. 25, 1988 | [JP] | Japan | 63-211188 |

[51] Int. Cl.[5] ..... B65H 45/16; B65H 45/22; B65H 45/30

[52] U.S. Cl. ..... 493/320; 493/395; 493/403; 493/435; 271/178; 271/188; 271/209; 271/220

[58] Field of Search ..... 493/320, 395, 403, 435; 271/161, 178, 188, 209, 220

[56] References Cited

U.S. PATENT DOCUMENTS

| | | | |
|---|---|---|---|
| 1,047,688 | 12/1912 | Nino et al. | 271/178 |
| 1,210,465 | 1/1917 | Gubelman | 271/188 |
| 3,325,165 | 6/1967 | Davis | 271/178 |
| 3,632,107 | 1/1972 | Rehm | 271/188 |
| 4,056,264 | 11/1977 | Dhooge et al. | 271/178 |
| 4,294,414 | 10/1981 | Gerstenberg | 271/188 |
| 4,345,754 | 8/1982 | Willenbring | 271/220 |
| 4,588,180 | 5/1986 | Ballestrazzi et al. | 271/209 |
| 4,732,375 | 3/1988 | Tetherton | 271/209 |
| 4,890,825 | 1/1990 | McCormick et al. | 271/188 |

FOREIGN PATENT DOCUMENTS

| | | | |
|---|---|---|---|
| 0210660 | 2/1987 | European Pat. Off. . | |
| 0220746 | 5/1987 | European Pat. Off. . | |
| 2569669 | 3/1986 | France | 271/209 |
| 61-275742 | 12/1956 | Japan . | |
| 57-179836 | 11/1982 | Japan . | |
| 58-149046 | 9/1983 | Japan . | |
| 58-149047 | 9/1983 | Japan . | |
| 59-152440 | 8/1984 | Japan . | |
| 59-154445 | 9/1984 | Japan . | |
| 59-165054 | 9/1984 | Japan . | |
| 59-168439 | 9/1984 | Japan . | |
| 59-174832 | 10/1984 | Japan . | |
| 59-174833 | 10/1984 | Japan . | |
| 59-174834 | 10/1984 | Japan . | |
| 59-174835 | 10/1984 | Japan . | |
| 59-180548 | 10/1984 | Japan . | |
| 0248852 | 11/1986 | Japan | 271/188 |
| 61-278849 | 12/1986 | Japan . | |
| 0012569 | 1/1987 | Japan | 271/188 |
| 62-65038 | 3/1987 | Japan . | |
| 62-173463 | 7/1987 | Japan . | |
| 62-209444 | 9/1987 | Japan . | |
| 62-183457 | 11/1987 | Japan . | |
| 62-253159 | 11/1987 | Japan . | |
| 0185747 | 8/1988 | Japan | 271/161 |

OTHER PUBLICATIONS

Korus, Gerard S., "Variable Sheet Deflector for Document Restacking", Xerox Disclosure Journal, vol. 6, No. 5, Sep./Oct. 1981.

*Primary Examiner*—William E. Terrell
*Attorney, Agent, or Firm*—Sughrue, Mion, Zinn, Macpeak & Seas

[57] ABSTRACT

An image recording apparatus wherein a photo-sensitive material and an image-receiving material are affixed to each other, an image recorded on the photo-sensitive material is transferred to the image-receiving layer, both materials are separated, and the photo-sensitive material is conveyed to a disposal tray is provided with a pair of rollers for forming a bead line along the direction of conveyance of the photo-sensitive material while the photo-sensitive material is being held and conveyed prior to reaching the disposal tray.

Accordingly, the bead line is formed on the photo-sensitive material before it reaches the disposal tray, thereby increasing its rigidity in the direction of conveyance.

16 Claims, 16 Drawing Sheets

IMAGE RECORDING APPARATUS

This is a continuation of Application No. 07/366,381 filed June 15, 1989, abandoned.

BACKGROUND OF THE INVENTION

1. Field of the invention

The present invention relates to an image recording apparatus wherein a photo-sensitive material and an image-receiving material are affixed to each other and an image recorded on the photo-sensitive material is transferred to the image-receiving material so that the image is obtained on the image-receiving material.

2. Description of the Related Art

Such an image recording apparatus has been known that a heat-developable photo-sensitive material is used as one of photo-sensitive materials, and the heat-developable photo-sensitive material to which an image is exposed and an image-receiving material are affixed to each other and heated so that the image of the heat-developable photosensitive material is heat developed and the image developed is transferred to the image-receiving material to obtain the image on the image-receiving material.

In an image recording apparatus of this type, such a separation means as a separator arm is disposed close to a heat-development and image transfer portion to separate the heat-developable photo-sensitive material from the image-receiving material after the heat-development and transfer process of the image have taken place. Moreover, the separated heat-developable photo-sensitive material is conveyed by a conveyor belt and stacked in a disposal box disposed at the lowest part of the apparatus.

However, since the heat-developable photo-sensitive material is conveyed while it is being wound around rollers, it is heated or it is subjected to the other processes, after the heat-developable photo-sensitive material has been subjected to the heat-development and transfer process is separated from the image-receiving material, it is curled.

In such a conventional image recording apparatus, the configuration is such that any curl generating in the heat-developable photo-sensitive material is not removed before the heat-developable photo-sensitive material is collected in the disposal box. Therefore, this results in the problems of the apparent volume of the heat-developable photo-sensitive material in the disposal box being large, and of reducing the actual amount that could be stacked in the disposal box.

One object of the present invention is to provide an image recording apparatus of simplified structure wherein the photo-sensitive material which has been subjected to a transfer process is conveyed definitely without occurrence of any jam after it is separated from the image-receiving material, and stacked in a small place without waste.

SUMMARY OF THE INVENTION

To this end, an image recording apparatus according to the present invention is constituted such that a photo-sensitive material and an image-receiving material are affixed to each other, an image recorded on the photo-sensitive material is transferred on the image-receiving material and the photo-sensitive material and the image-receiving material are separated from each other by a separation device to obtain the image on the image-receiving material, and is also provided with a stacking device for stacking the photo-sensitive material conveyed after separation by said separation means, and a bending device for bending the photo-sensitive material along a straight line linking the leading and trailing ends of the photo-sensitive material conveyed to the stack device to form a bent portion on the photo-sensitive material.

In the image recording apparatus of the configuration described above, the photo-sensitive material in which the image thereof has been transferred to the image-receiving material is separated from the image-receiving material by the separation device. After the separated photo-sensitive material is formed by the bending device with the curve along the straight line linking its leading and trailing ends, the photo-sensitive material is stacked in the stacking device.

Each of the stacked photo-sensitive materials is formed with the curve and its rigidity is increased in the direction of its conveyance and so the generation of curl can be prevented and the photo-sensitive materials are stacked in a regular manner in the stack device. Accordingly, there is no increase in the apparent volume of the stacked photo-sensitive materials and the space in the stacking device can be effectively utilized, enabling the apparatus to be made more compact.

Also, one aspect of the present invention is provided with a pressing member for pressing and holding the photo-sensitive material stored in the disposal tray of the stacking device. Therefore, after stacking, the photo-sensitive material is pressed and held by the pressing member so that curl does not regenerate with the passage of time.

Furthermore, in another aspect of the present invention the bending device includes a pair of first rollers to shape a bead line extended in the direction of conveyance of the photo-sensitive material as the bent portion, and a pair of second rollers for holding the photo-sensitive material therebetween and conveying it, disposed in a predetermined positional relationship with said pair of first rollers. Also, there are instances where irregular waves are formed on the photo-sensitive material because of the shaping of the bead line on the photo-sensitive material on the upstream side of the pair of first rollers. However, because the photo-sensitive material is held securely by the pair of second rollers, the shaped bead line do not continue upstream of the second rollers and therefore exert no adverse influence such as paper misfeeds or so called "jams" to the conveyance of the photo-sensitive material.

In this invention, the photo-sensitive material can be any material wherein a visible image is produced on the image-receiving material by the transfer of an image obtained through image exposure.

Heat-developable photo-sensitive materials or photo-sensitive pressure-sensitive materials are two examples of color dispersal transfer photo-sensitive materials. The above-described heat-developable photo-sensitive material is disclosed in U.S. Pat. Nos. 4,463,079; 4,474,867; 4,478,927; 4,507,380; 4,500,626; 4,483,914 and 4,740,445; Japanese Patent Application Laid-Open Nos. 149,046/1983; 149,047/1983; 152,440/1984; 154,445/1984; 165,054/1984; 180,548/1984; 168,439/1984; 174,832/1984; 174,833/1984; 174,834/1984; 174,835/1984; 65,038/1987; 253,159/1987; 173,463/1987 and 183,457/1962; and in European Patent Application Laid-Open No. 210,660A2 and 220,746A2.

Furthermore, the photo-sensitive material is disclosed in Japanese Patent Application Laid-Open Nos. 179,836/1982; 275,742/1986; 278,849/1986; and 209,444/1987.

DESCRIPTION OF THE PREFERRED EMBODIMENT

The following is a description of an image recording apparatus relating to an embodiment of the present invention.

Figure 5:
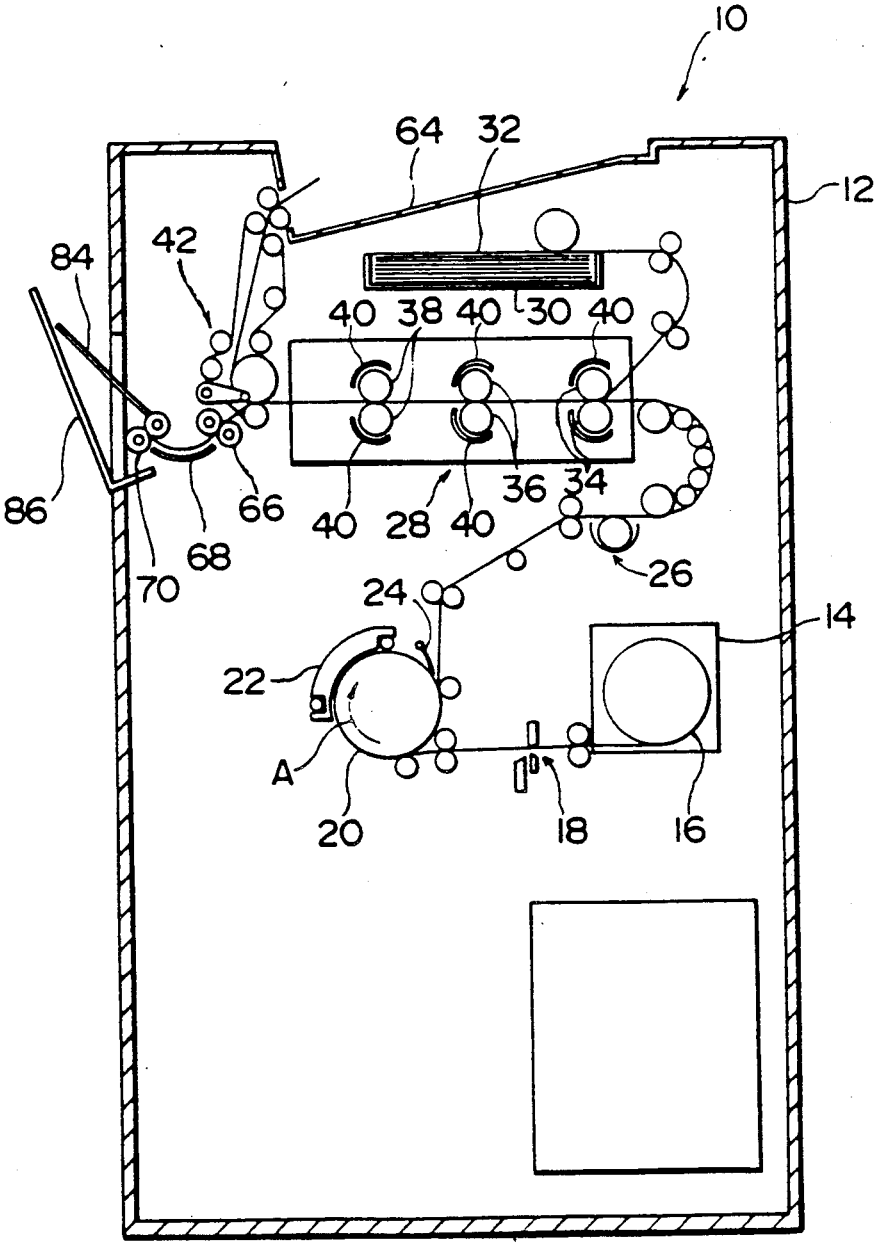
FIG. 5 is an outline structural view showing the configuration of the image recording apparatus of the first embodiment.

FIG. 5 shows an image recording apparatus 10 according to a first embodiment of the present invention.

In the image recording apparatus 10, a roll of heat-developable photo-sensitive material 16 is stored in a magazine 14 house din a base 12. This heat-developable photo-sensitive material 16 is unrolled from the outermost layer of the roll, cut to a predetermined length by a cutter 18, and wound around the outer periphery of a rotating drum 20. An exposure head 22 is disposed so as to face to the outer periphery of the rotating drum 20, so that when the rotating drum 20 is rotated in the direction of the arrow A, an image is exposed on the photo-sensitive material 16 wound around the outer periphery of the rotating drum 20.

After exposure, the rotating drum 20 is rotated in the reverse direction so that the heat-developable photo-sensitive material 16 is separated form the rotating drum 20 by a scraper 24. The heat-developable photo-sensitive material 16 is then subjected to the application of water as an image forming solution in a water applying part 26, and is then sent to a heat-developable image transfer part 28.

On the other hand, the uppermost of plurality of sheets of image-receiving material 32 stored in a tray 30 is sent to a heat-developing and image-transfer part 28.

At the heat-developing and image-transfer part 28 disposed at equal intervals are pairs of conveyor rollers 34, 36 and 38 with each roller of each pair in contact with the other roller of that pair. These pairs of conveyor rollers 34, 36 and 38 are linked to a motor not indicated in the figure, and the drive force of this motor is transmitted to rotate these pairs of conveyor rollers 34, 36 and 38 so that the heat-developable photo-sensitive material 16 and the image-receiving material 32 are held and conveyed in affixed condition by the pairs of rollers.

Around the periphery of each of these pairs of conveyor rollers 34, 36 and 38 are disposed heaters 40. Because of these heaters 40, the heat-developable photo-sensitive material 16 and image-receiving material 32 are heated while being pressed together, held and conveyed by each of the pairs of rollers.

Figure 2:
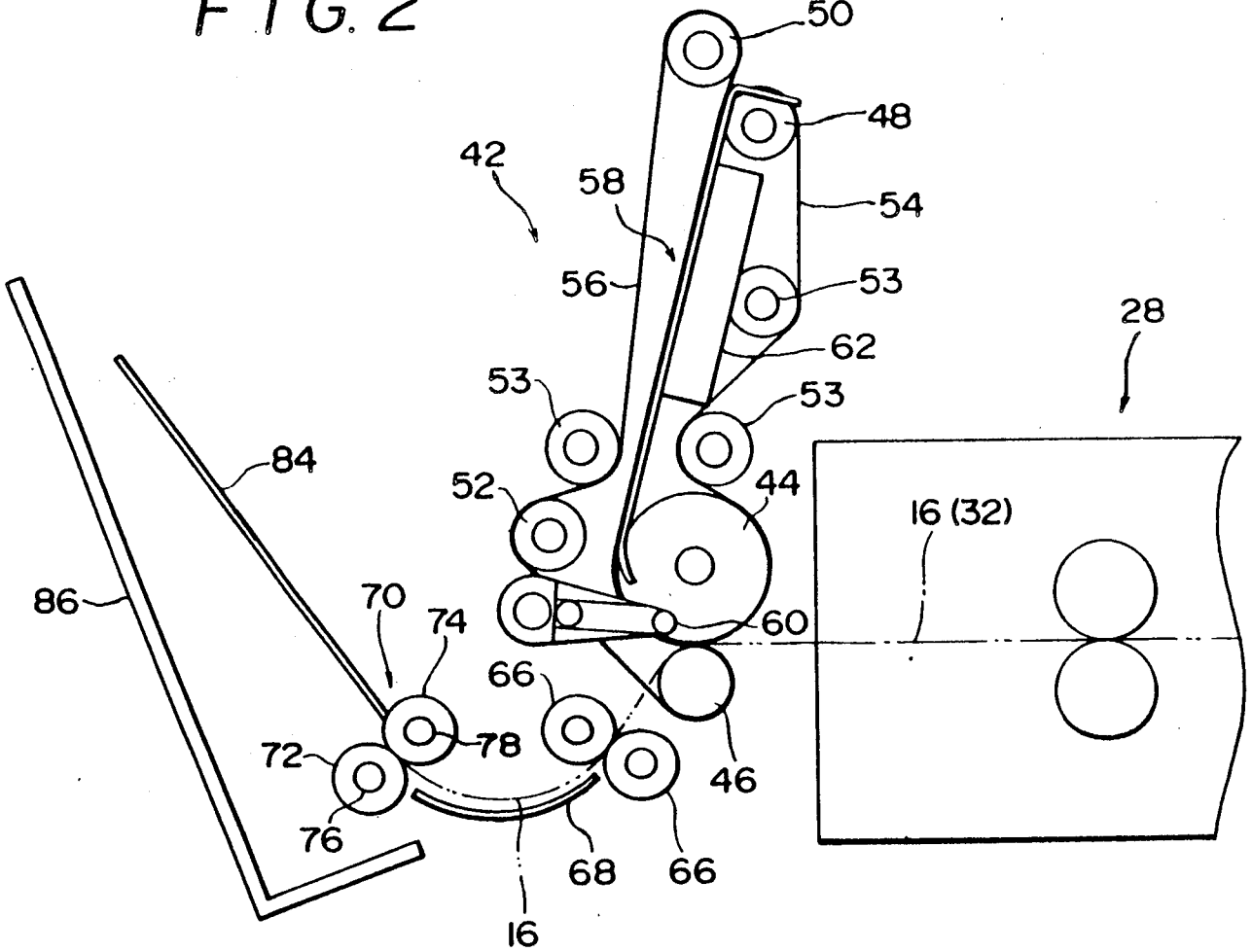
FIG. 2 is a sectional view showing the shaping rollers and their peripheral members of the image recording apparatus of a first embodiment.
Figure 3:
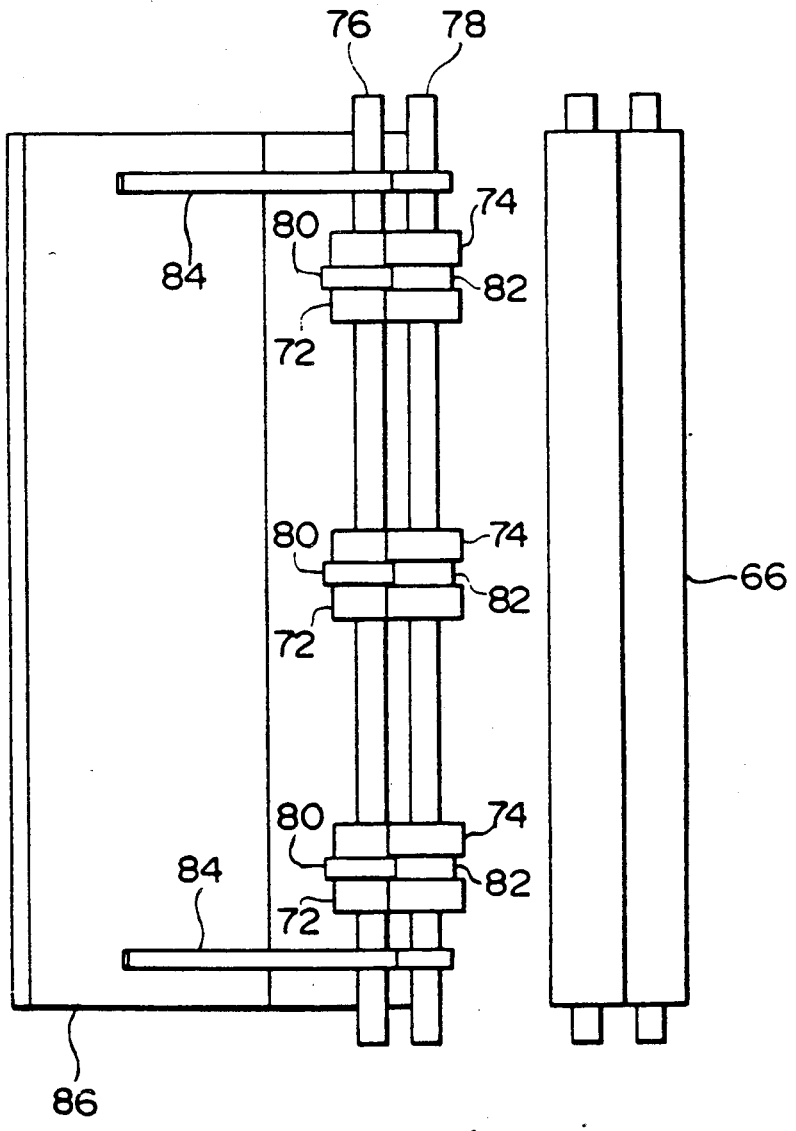
FIG. 3 is a plan view showing the shaping rollers and their peripheral members of the image recording apparatus first embodiment.
Figure 4:
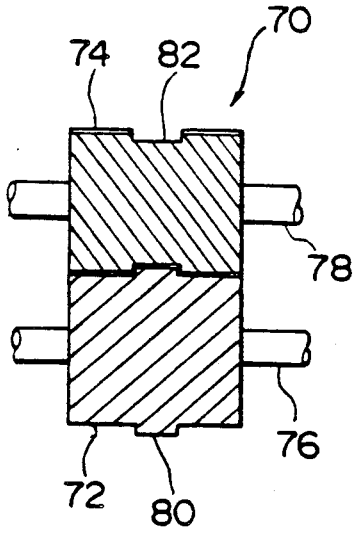
FIG. 4 is a sectional view of the shaping rollers of the image regarding apparatus of the first embodiment.

Downstream from the heat-developing and image-transfer part 28 is disposed a separation part 42. As is shown in FIG. 2, in this separation part 42 are disposed pairs of opposing rollers 44 and 46, rollers 48 and 50, a roller 52 and a plurality of tensioning rollers 53. An endless belt 54 is engaged with the rollers 44 and 48 and an endless belt 56 is engaged with the roller 46, the roller 50 and the roller 52. The portion of the endless belt 56 between the roller 46 and the roller 50 is in contact with the portion of the endless belt 54 between the roller 44 and the roller 48, so that an image-receiving material conveyor path 58 is formed between these portions.

A separator arm 60 is disposed close to the roller 44 and the roller 46, and so as to separate the heat-developable photo-sensitive material 16 and the image-receiving material 32 sent from the heat-developing and image-transfer part. The image-receiving material 32 is separated by the separator arm 60 and is held and conveyed by the endless belt 54 and the endless belt 56 along the image-receiving material conveyor path 58.

Inside the endless belt 54 is disposed a heater 62 which resides along the image-receiving material conveyor path 58 so as to dry the conveyed image-receiving material 32. After drying, the image-receiving material 32 is sent to a pick-up tray 64 formed at the top of the base 12 (refer to FIG. 5).

Figure 1:
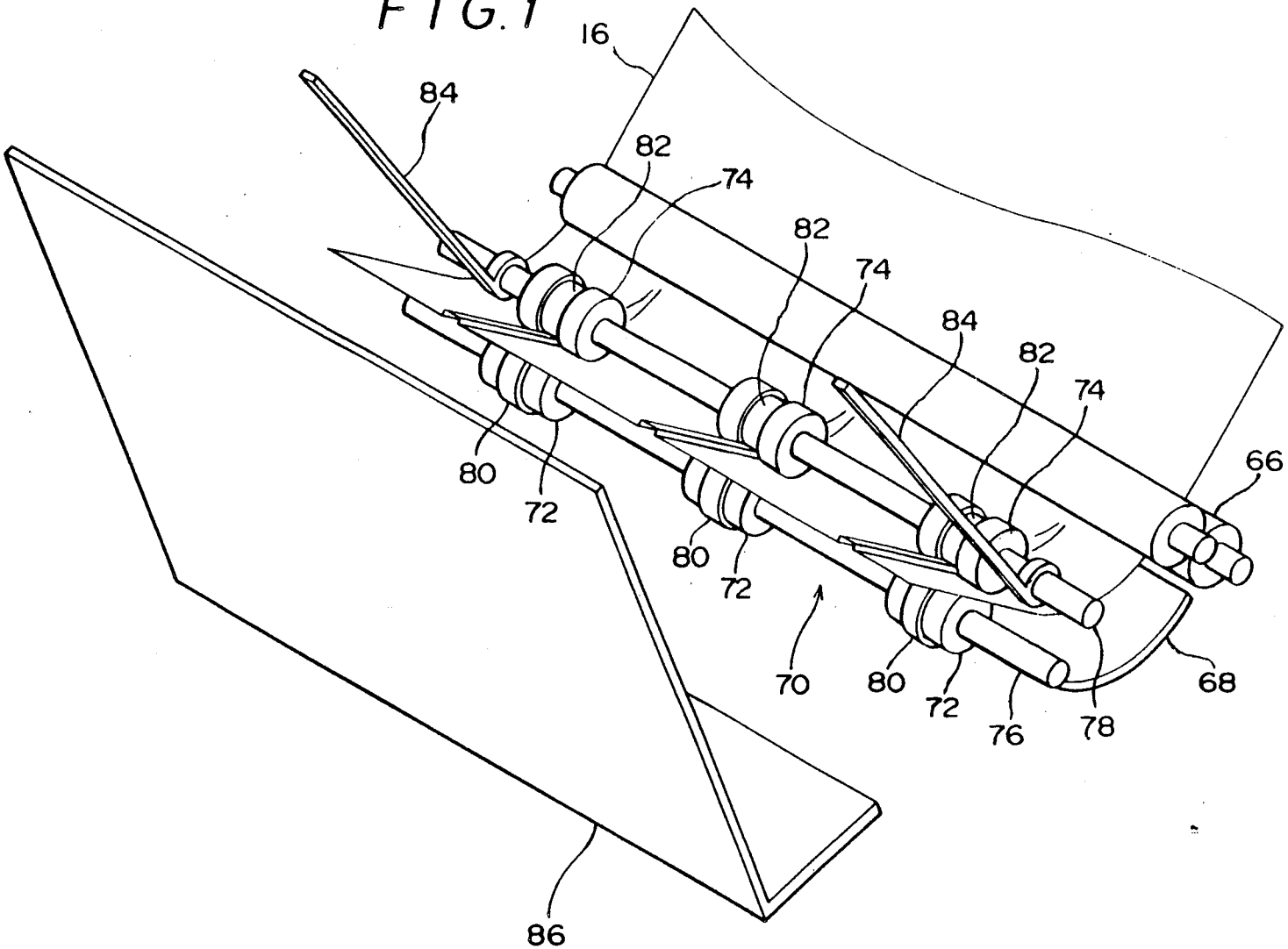
FIG. 1 is a perspective view showing the shaping rollers and their peripheral members of an image recording apparatus of a first embodiment of the present invention.

As indicated in FIG. 1 and FIG. 2, directly beneath the separator arm 60 is disposed a pair of conveyor rollers 66 in contact with each other so as to hold and convey the heat-developable photo-sensitive material 16 separated by the separator arm 60.

Directly beneath the pair of conveyor rollers 66 are disposed an arc-shaped guide plate 68 and near the end of the guide plate 68 are disposed shaping rollers 70 as bending means. Because of this, the heat-developable photo-sensitive material 16 that is held and conveyed by the pair of conveyor rollers 66 is guided by the arc-shaped guide plate 68 and sent to the shaping rollers 70.

The positional relationship between the pair of conveyor rollers 66 and the shaping rollers 70 is such that when the leading edge of the heat-developable photo-sensitive material 16 is held by the shaping rollers 70, at least the trailing edge thereof is still held by the pair of conveyor rollers 66.

The configuration of the shaping rollers 70 is such that a plurality of male roller members 72 and the same number of female roller members 74 are mounted on shafts 76 and 78 respectively. The shafts 76 and 78 are driven by a drive means not indicated in the figures, so that the male roller members 72 and the female roller members 74 both receive the drive force of this drive means and are rotated so as to hold and convey the heat-developable photo-sensitive material 16.

The outer peripheries of the female roller members 74 are knurled so as to securely convey the heat-developable photo-sensitive material 16.

The outer periphery of each of the male roller members 72 is formed with a rectangularly protruding circular portion 80, while the outer periphery of each of the female roller members 74 is formed with rectangularly recessed circular portion 82, and the portions 80 and 82 are fitted to each other. Therefore, the heat-developable photo-sensitive material 16 held and conveyed by the male roller members 72 and the female roller members 74 is formed with bead lines in the shape of an inverted "U" along the conveying direction of the heat-developable photo-sensitive material 16 by the protruding circular portions 80 and the recessed circular portions 82.

To the shaft 78 having the female roller members 74 is mounted a pair of pressing bars 84 as pressing members, which are always pressing downwards by their own weight.

At the front of the shaping rollers 70 is disposed a disposal tray 86 in which the heat-developable photo-sensitive material 16 held and discharged by the shaping rollers 70 is stacked. When this happens, the stacked heat-developable photo-sensitive material 16 is pressed by the pair of pressing bars 84 mounted to the shaft 78.

The following is a description of the operation of this embodiment of the present invention.

The heat-developable photo-sensitive material 16 is drawn out from the magazine 14, cut by the cutter 18, and wound around the outer periphery of the rotating drum 20. The rotating drum 20 holding the heat-developable photo-sensitive material 16 rotates at high speed and an image is exposed on the heat-developable photo-sensitive material 16 by the exposure head 22.

After exposure, the heat-developable photo-sensitive material 16 is separated from the rotating drum 20 by the scraper 24, has water applied to it in the water applying part 26 and is sent to the heat-developing image-transfer part 28.

On the other hand, the uppermost of the plurality of sheets of image-receiving material 32 stored in the tray 30 is sent to the heat-developing and image-transfer part 28 where it is affixed to the heat-developable photo-sensitive material 16.

After affixing, the heat-developable photo-sensitive material 16 and the image-receiving material 32 are held and conveyed by the pairs of rotating conveyor rollers 34, 36 and 38. In the process of being held and conveyed by these rollers the heat-developable photo-sensitive material 16 and the image-receiving material 32 are heated by the heaters 40 in each of the pairs of rollers 34, 36 and 38 so that heat is transmitted to affix the heat-developable photo-sensitive material 16 and image-receiving material 32 to each other. In the process the heat-developable photo-sensitive material 16 is heat-developed and at the same time the image developed on the heat-developable photo-sensitive material 16 is transferred to the image-receiving material 32, so that an image is obtained on image-receiving material 32.

After transfer, the heat-developable photo-sensitive material 16 and the image-receiving material 32 are sent to the separation part 42. In the separation part 42, the heat-developable photo-sensitive material 16 and the image-receiving material 32 are separated from each other by the separator arm 60.

The image-receiving material 32 separated by the separator arm 60 is held and conveyed by the endless belt 54 and the endless belt 56 (i.e. by the image-receiving material conveyor path 58) and while this is occurring, is dried by the heater 62 disposed inside the endless belt 54 and sent to the top of the pick-up tray 64 at the top of the base 12.

The heat-developable photo-sensitive material 16 separated by the separator arm 60 is held and conveyed by the pair of conveyor rollers 66 disposed directly beneath the separator arm 60.

Since directly beneath the pair of conveyor rollers 66 is disposed an arc-shaped guide plate 68, the heat-developable photo-sensitive material 16 is guided by the arc-shaped guide plate 68 and sent to the shaping rollers 70.

At the shaping rollers 70, the male roller members 72 and the female roller members 74 receive a drive force and are rotated so as to hold and convey the heat-developable photo-sensitive material 16. When this happens, the heat-developable photo-sensitive material 16 is securely conveyed because the outer peripheries of the female rollers 74 are knurled.

The outer peripheries of the male roller members 72 are formed with the protruding circular portions 80 while the outer peripheries of the female roller members 74 are formed with the recessed circular portions 82, and the protruding and recessed circular portions 80 and 82 are fitted to each other. Therefore, the heat-developable photo-sensitive material 16 held and conveyed by the male roller members 72 and the female roller members 74 is formed with bead lines in the shape of an inverted "U" along the conveying direction of the material materials by the protruding circular portions 80 and the recessed circular.

After the heat-developable photo-sensitive material 16 has passed the shaping rollers 70, its rigidity in the direction of conveyance increases because of the bead lines. There are instances where irregular waves are formed in the material as a result of the formation of the bead lines. These waves may extend to the upstream side of the pair of shaping rollers 70. However, because the heat-developable photo-sensitive material 16 is held securely by the pair of conveyor rollers 66, the waves are not transmitted to upstream of the conveyor rollers 66 and therefore exert on adverse influence on the conveyance of the heat-developable photo-sensitive material 16.

The heat-developable photo-sensitive material 16 held and conveyed by the shaping rollers 70 is stacked in the disposal tray 86. The material 16 stacked in the disposal tray 86 is pressed by the pressing bars 84.

The bead lines formed in the stacked heat-developable photo-sensitive material 16 increase the rigidity so that there is no apparent increase in the volume of the stacked heat-developable photo-sensitive material 16 and so that the space of the disposal tray 86 can be effectively utilized, enabling the disposal tray 86 to be made more compact. Also, since the heat-developable photo-sensitive material 16 stacked is pressed and held by the pressing bars 84, curl is prevented from occurring in accordance with the passage of time.

Moreover, the pair of conveyor rollers 66, the shaping rollers 70 and the disposal tray 86 are disposed immediately after the separation means 42 on the conveyor path for the heat-developable photo-sensitive material 16 and so the conveyor path for the heat-developable photo-sensitive material 16 is very short after separation from the image-receiving material 32 in the separation part 42. It is therefore possible to use few parts and to reduce the cost, and also to eliminate generation of paper misfeeds (so-called "jams") because of the increased rigidity due to the bead lines.

Figure 6:
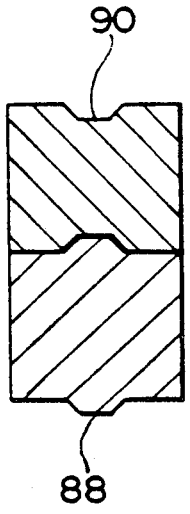
FIG. 6 is a sectional view showing an alternative shape for the shaping rollers of the image recording apparatus of a first embodiment.
Figure 7:
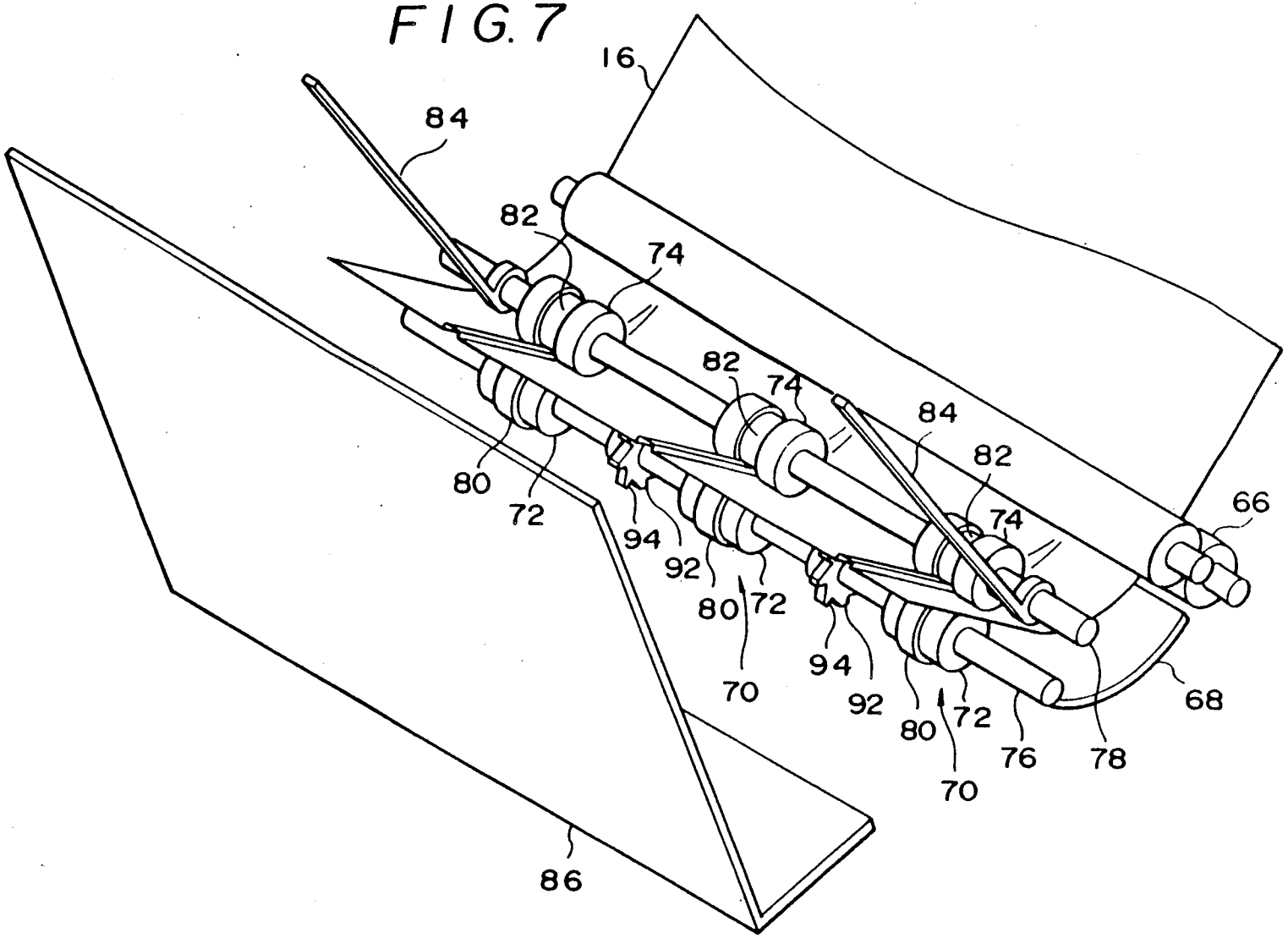
FIG. 7 is a perspective view showing shaping rollers, discharge roller and their peripheral members of an image recording apparatus of a second embodiment of the present invention.
Figure 8:
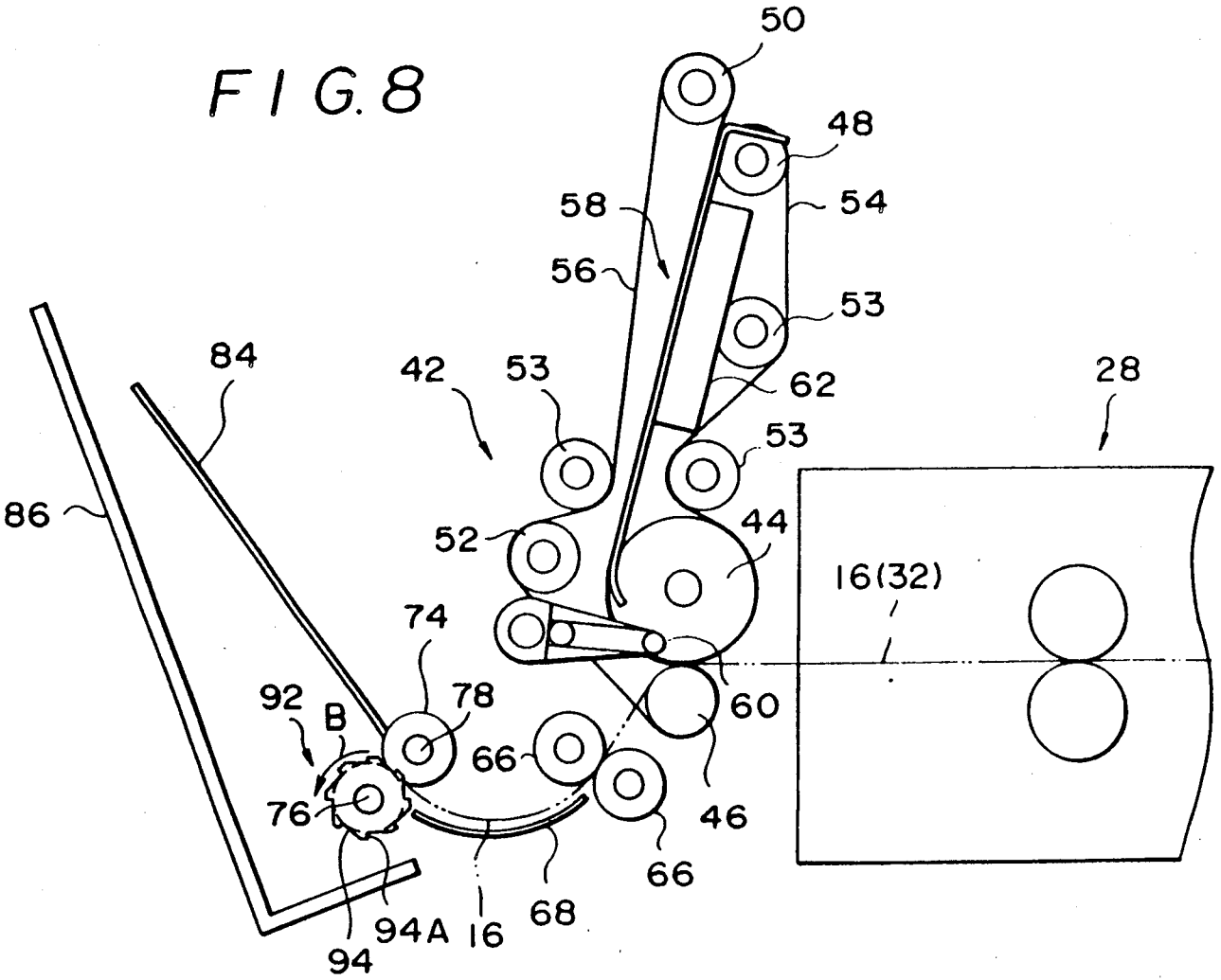
FIG. 8 is a sectional view showing the shaping rollers, the discharge roller and their peripheral members of the image recording apparatus of the second embodiment of this invention.
Figure 9:
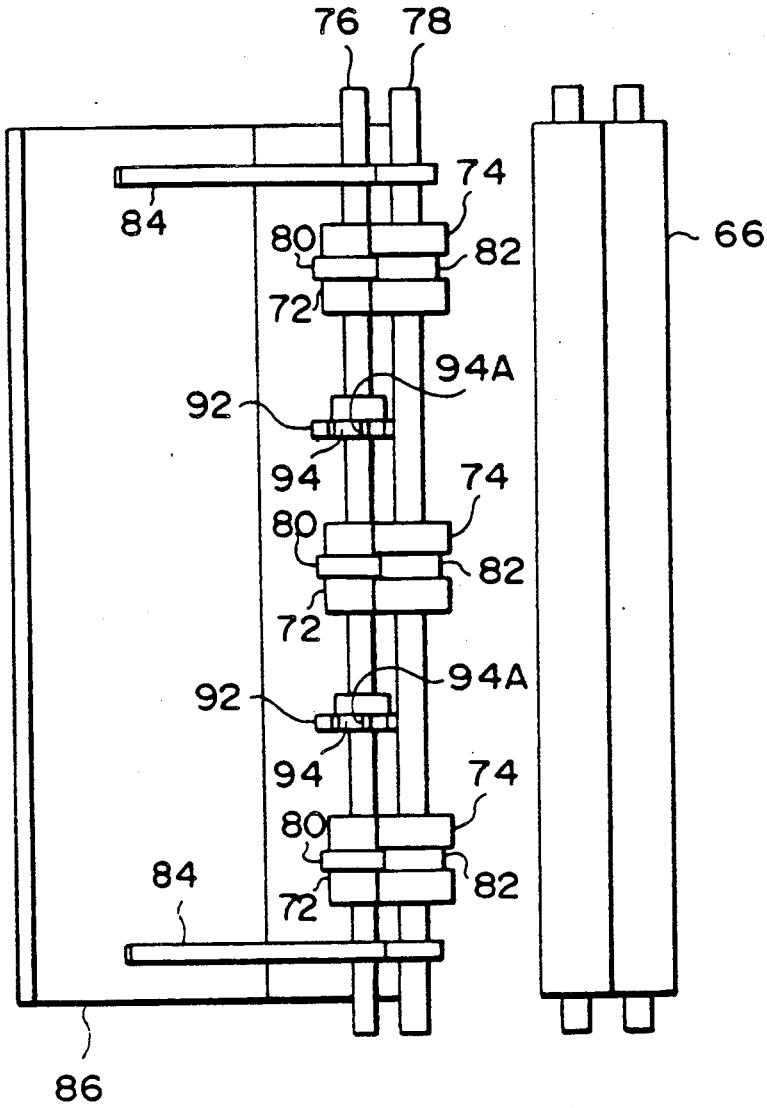
FIG. 9 is a plan view showing the shaping rollers, the discharge roller and their peripheral members of the image recording apparatus of the second embodiment.
Figure 10:
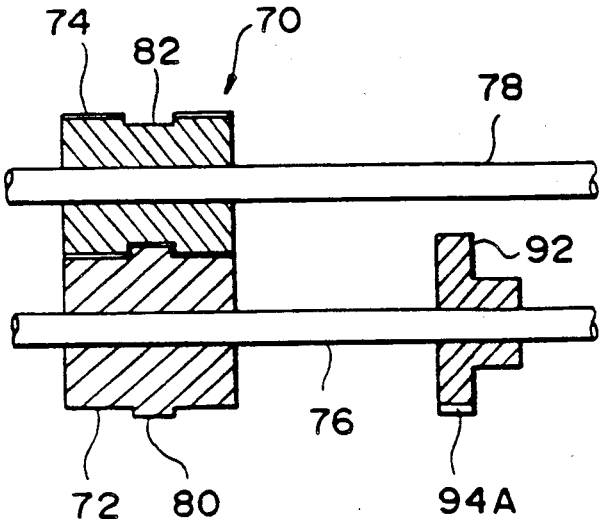
FIG. 10 is a sectional view of the shaping rollers and the discharge roller of the image recording apparatus of the second embodiment.

Moreover, in this embodiment of the present invention, the protruding circular portion 80 formed on the external periphery of each of the male roller members 72 and the recessed circular portion 82 formed on the external periphery of each of the female rollers 74 are both formed with rectangular sections, but, as shown in FIG. 6, protruding circular roller members and recessed circular members formed in a trapezoidal sectional configuration may be used instead protruding circular portion 80 and the recessed circular.

The following is a description of an image recording apparatus relating to a second embodiment.

Those parts of this second embodiment that are substantially the same as corresponding parts in the first embodiment are indicated with the same numerals, and the explanation for them is omitted.

As shown in FIG. 7 through FIG. 10, in addition to the arrangement of the first embodiment, there are also provided between adjacent male roller members 72 discharge roller members 92 as a forced discharge means, mounted to the same shaft 76 as the male roller members 72 so as to rotate along with the male roller members 72.

The peripheries of discharge roller members 92 are formed as ratchet gears having a plural sawtooth cut parts 94, the ends of which face in the direction of rotation of the discharge roller members 92. That is, wall surfaces 94A are formed radially of the discharge roller members 92, In this embodiment, the depth of the wall surfaces 94A is 2 mm.

At the time when the heat-developable photo-sensitive material 16 having the bead lines is separated from the shaping roller members 70, i.e. when it is no longer held by them, the wall surfaces 94A of the cut parts 94 engage with the trailing end of the heat-developable photo-sensitive material 16 and push and guide it so that the rotation of the discharge roller members 92 forces the heat-developable photo-sensitive material 16 downwards i.e., in the direction of rotation, after it has been released from the male roller members 72 and female roller members 74.

To shaft 78 of the female roller members 74 is mounted the pair of pressing bars 84 as pressing members, which are always pressing downwards by their own weight. This configuration is the same as that of the first embodiment.

At the front of the shaping roller members 70 is disposed the disposal tray 86 as the stacking means, into which the heat-developable photo-sensitive material 16 forcedly sent from the shaping rollers 70 by the discharge roller members 92 is received and stacked. The stacked heat-developable photo-sensitive material 16 is pressed by the pair of pressing bars 84 mounted to the shaft 78.

The following is a description of the operation of the second embodiment.

As in the first embodiment, the heat-developable photo-sensitive material 16 and the image-receiving material 32 are subjected to the heat-developing and transfer process in the heat-developing and image-transfer part 28 and are then sent to the separation part 42 and separated from each other by the separator arm 60.

The heat-developable photo-sensitive material 16 separated by the separator arm 60 is held and conveyed by the pair of conveyor rollers 66 disposed immediately beneath the separator arm 60. Directly beneath the pair of conveyor rollers 66 is disposed the arc-shaped guide plate 68, and the heat-developable photo-sensitive material 16 is guided by the arc-shaped guide plate 68 and sent to the shaping rollers 70.

At the shaping rollers 70, the male roller members 72 and the female roller members 74 receive a drive force and are rotated so as to hold and convey the heat-developable photo-sensitive material 16. The heat-developable photo-sensitive material 16 is securely conveyed because the outer peripheries of the female roller members 74 are knurled.

The outer peripheries of the male roller members 72 are formed with the protruding circular portions 80 while the outer peripheries of the female roller members 74 are formed with recessed circular portions 82, and the protruding circular portions 80 and the recessed circular portions 82 are in engagement with each other. Therefore, the heat-developable photo-sensitive material 16 held and conveyed by the male roller members 72 and the female roller members 74 is formed with bead lines in the shape of an inverted "U" along the direction of conveyance.

Therefore, after the heat-developable photo-sensitive material 16 has passed the shaping rollers 70, its rigidity in the direction of conveyance increases because of the bead lines. Irregular, waves formed because of the formation of the bead lines on the heat-developable photo-sensitive material 16 on the upstream side of the pair of shaping rollers are not transmitted on upstream of the conveyor rollers 66 and therefore exert no adverse influence on the conveyance of the heat-developable photo-sensitive material, as is in the first embodiment.

The heat-developable photo-sensitive material 16 is conveyed while the bead lines are being formed and when the trailing end thereof passes the shaping rollers 70 (i.e. the point at which it is no longer being held), the wall surfaces 94A of the plurality of sawtooth cuts 94 formed in the discharge roller members 92 engage the trailing end of the heat-developable photo-sensitive material 16 and press against it and guide it so that the rotation of the discharge roller members 92 forces the heat-developable photo-sensitive material 16 downwards (in the direction of the arrow B in FIG. 8) after it has been released from the male roller members 72 and female roller members 74. Therefore, misfeeding ("jamming") of the heat-developable photo-sensitive material 16 between the female, roller members 74 and male roller members 72 of the shaping rollers does not occur either while the bead lines are being formed or after the bead lines have been formed by the shaping rollers 70.

The heat-developable photo-sensitive material 16 that has been forcedly sent from the shaping rollers 70 by the discharge roller members 92 is stacked in the disposal tray 86. The stacked heat-developable photo-sensitive material 16 in the disposal tray 86 is pressed and held by the pair of pressing bars 84.

The heat-developable photo-sensitive material 16 is stacked regularly because of the increase in rigidity due to the bead lines. Accordingly, there is no increase in the apparent volume after stacking, and the space of the disposal tray 86 can be effectively utilized, enabling it to be made more compact. Moreover, after stacking, the heat-developable photo-sensitive material 16 is pressed and held by the pair of pressing bars 84 so that curl does not regenerate with the passage of time. It is possible to use few parts and to reduce the cost, and to eliminate paper misfeeds (so-called "jams") because of, the increased rigidity due to the bead lines and the forcible discharge from the shaping rollers 70 by the discharge roller members 92.

Figure 11:
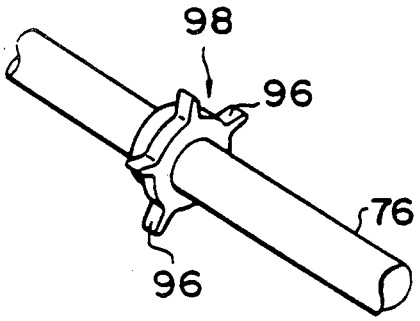
FIG. 11 is a perspective view showing an alternative shape for the discharge roller of the image recording apparatus of the second embodiment.

In this embodiment of the present invention, the configuration of the discharge roller members 92 provided as a forced discharge means is such that the plurality of sawtooth cuts 94 are formed around the discharge roller members 92, but, as shown in FIG. 11, instead of the discharge roller members 92 discharge roller members 98 having arm parts 96 protruding radially can be used.

The following is a description of an image recording apparatus relating to a third embodiment of the present invention. Those parts of the third embodiment that are substantially the same as corresponding parts in the second embodiment are indicated with the same numerals, and the explanation for them is omitted.

Figure 12:
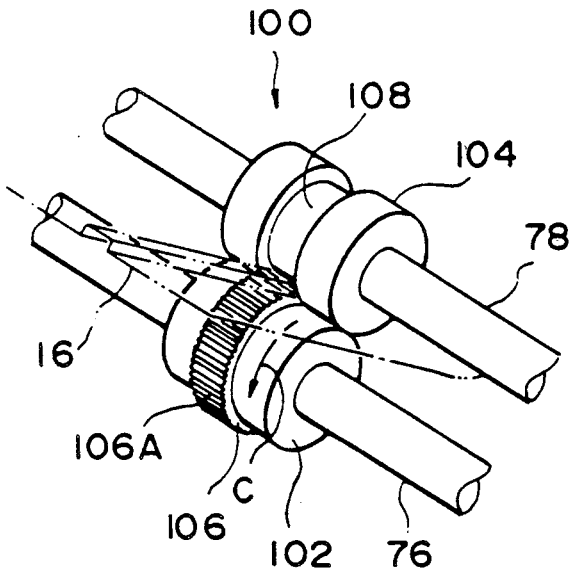
FIG. 12 is a perspective view showing shaping rollers used in an image recording apparatus of a third embodiment of the present invention.

FIG. 12 shows shaping rollers 100 relating to the third embodiment of this invention.

The shaping rollers 100 include a male roller member 102 and female roller member 104 which receive a drive force and are rotated to hold and convey the heat-developable photo-sensitive material 16.

In the same manner as in the first embodiment, a rectangularly protruding circular portion 106 is formed around the periphery of the male roller member 102, a rectangularly recessed circular portion 108 is formed around the periphery of the female roller member 104, with both portions being in engagement with each other so that the shaping rollers 100 form a bead line having the sectional shape of an inverted "U" along the direction of conveyance of the heat-developable photo-sensitive material 16.

The periphery 106A of the protruding circular portion 106 is formed with a fine knurled portion as a forced discharge means. This periphery 106A engages the conveyed heat-developable photo-sensitive material 16 while the bead line is being formed to guide it and forcibly discharge the heat-developable photo-sensitive material 16 from the contact portion between the male roller member 102 and the female roller member 104 downwardly, i.e,, in the direction of arrow C in FIG. 12, in the same manner as the first embodiment.

In this embodiment, therefore, when the trailing end of the heat-developable photo-sensitive material 16 conveyed while the bead line is being formed passes the shaping rollers 100 it is engaged with the periphery 106A of the protruding circular portion 106 so that the material 16 is pressed by the periphery 106A and guided and to be forcibly discharged downwards, i.e., along the direction of rotation of the periphery 106A, from the contact portion between the shaping rollers 100. As a result, the misfeeding, or "jamming", of the heat-developable photo-sensitive material 16 between the male roller member 102 and the female roller member 104 does not occur either while the bead line is being formed or after the bead line has been formed by the shaping rollers 100, and the heat-developable photo-sensitive material 16 positively discharged.

When this happens, the stacked heat-developable photo-sensitive material 16 is stacked regularly because of the increase in rigidity due to the formed bean line, and the space of the disposal tray 86 can be effectively utilized, enabling it to be made more compact.

The following is a description of the operation of a fourth embodiment of the present invention.

Those parts of this fourth embodiment that are substantially the same as corresponding parts in the first embodiment and the second embodiment are indicated with the same numerals, and the explanation for them is omitted.

Figure 13:
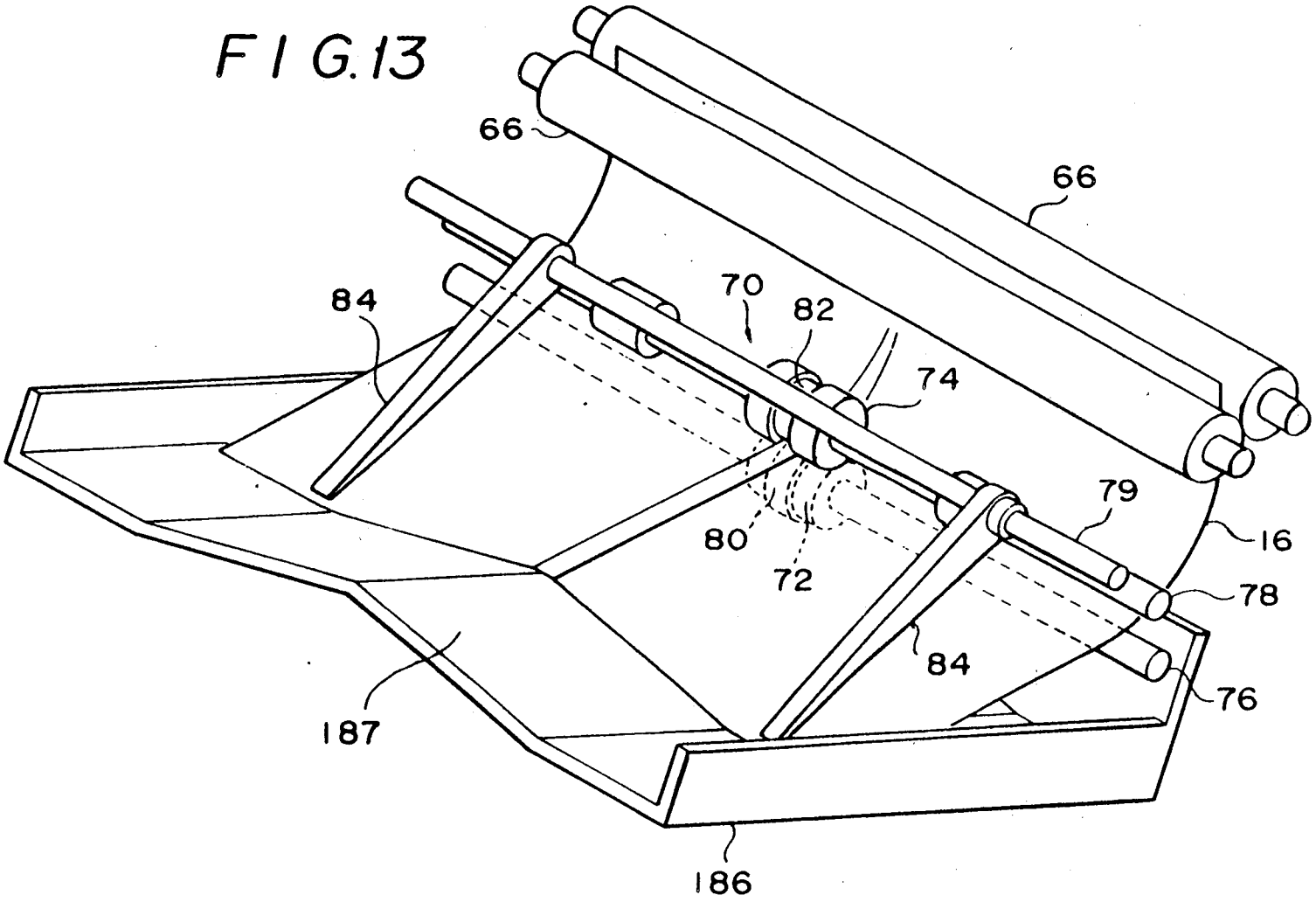
FIG. 13 is a perspective view showing shaping rollers, discharge tray and peripheral portions of an image recording apparatus of a fourth embodiment of the present invention.
Figure 14:
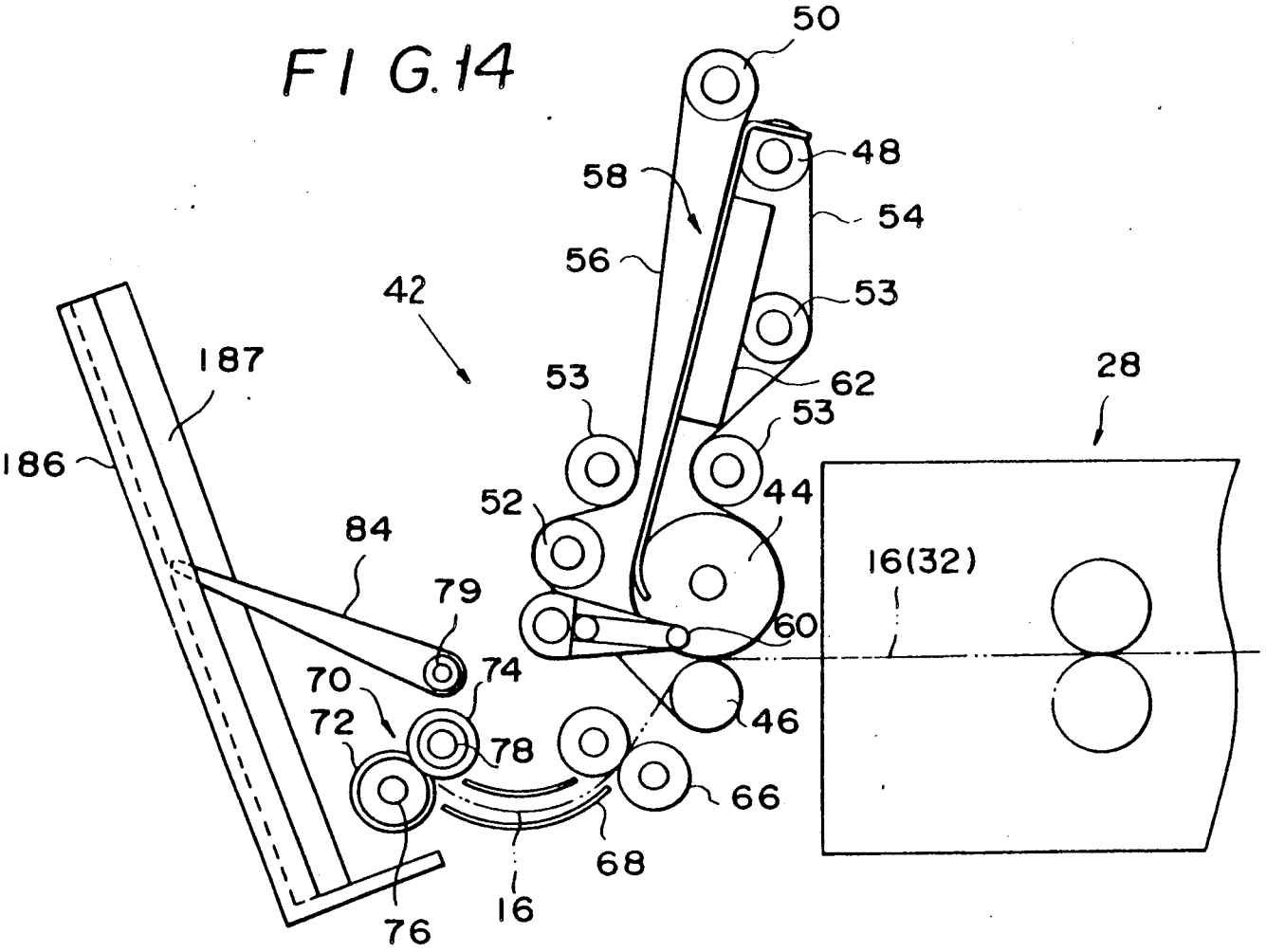
FIG. 14 is an outline sectional view showing the shaping rollers, the discharge tray and the peripheral parts of the image recording apparatus of the fourth embodiment.
Figure 15:
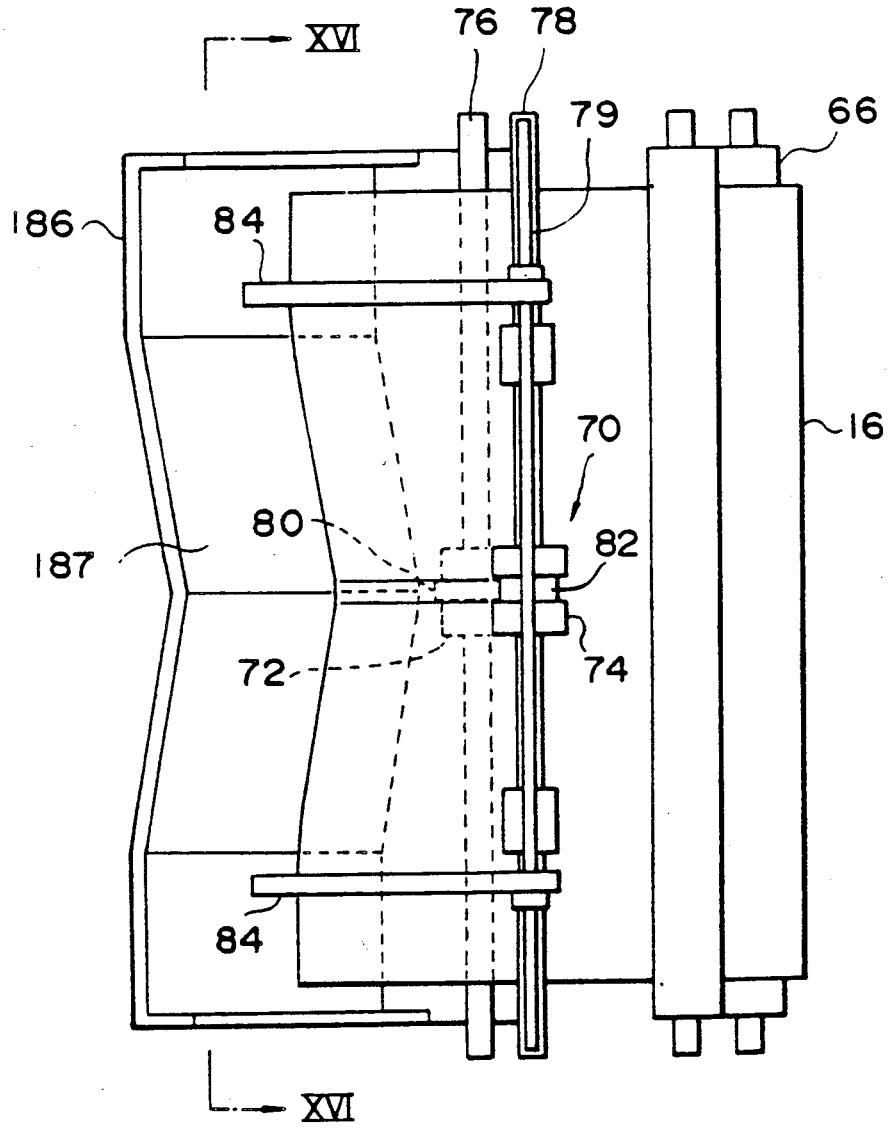
FIG. 15 is a plan view showing the shaping rollers, the discharge tray and the peripheral parts of the image recording apparatus of the fourth embodiment.

As indicated in FIGS. 13 to 15, directly beneath the separator arm 60 in the separation part 42 is disposed the pair of conveyor rollers 66 in the contact with each other, which hold and convey the heat-developable photo-sensitive material 16 separated by the separator arm 60.

Directly beneath the pair of conveyor rollers 66 is disposed arc-shaped guide plate 68 and near the end of the arc-shaped guide plates 68 are disposed shaping rollers 70 as bending means. The heat-developable photo-sensitive material 16 that is held and conveyed by the pair of conveyor rollers 66 is guided by the arc-shaped guide plate 68 and sent to the shaping rollers 70.

The configuration of the shaping rollers 70 is such that the male roller member 72 and the female roller member 74 are mounted on respective shafts 76 and 78, and disposed so as to correspond to the middle of the width of the heat-developable photo-sensitive material 16.

The shafts 76 and 78 are driven by a drive means not indicated in the figures, so that the male roller member 72 and the female roller member 74 both receive the drive force of this drive means and are rotated so as to hold and convey the heat-developable photo-sensitive material 16.

The outer periphery of the female roller member 74 is subjected to a knurling process so as to securely convey the heat-developable photo-sensitive material 16.

The heat-developable photo-sensitive material 16 held and conveyed by the male roller member 72 and the female roller member 74 is bent along the direction of the conveyance, i.e., formed with a bead line having a sectional shape of an inverted "U", and in the middle across its width, by the protruding circular portion 80 and the recessed circular portion 82.

To a shaft 79 above the female roller member 74 is mounted the pair of pressing bars 84 as pressing members, and which are always pressing downwards by their own weight.

Figure 16:
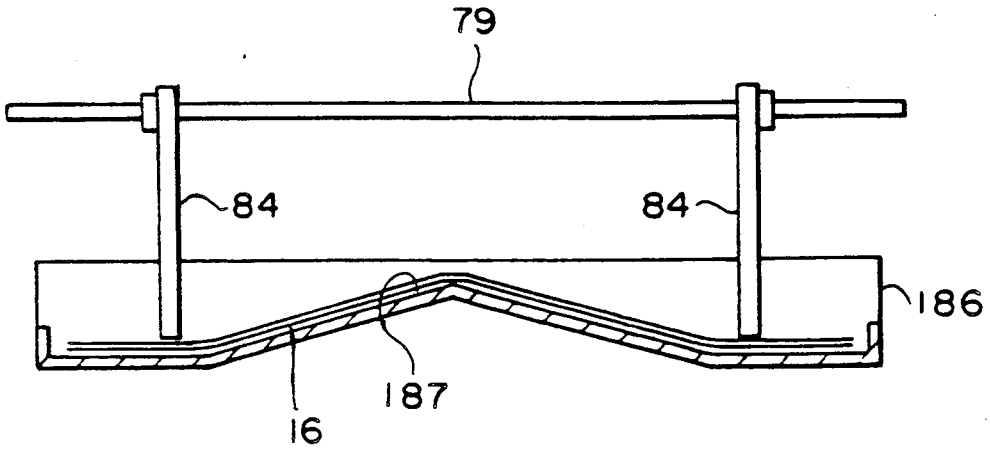
FIG. 16 is a sectional view taken along line XVI—XVI of FIG. 15.

At the front of the shaping rollers 70 is disposed a disposal tray 186 in which the heat-developable photo-sensitive material 16 held and sent by the shaping rollers 70 is stacked. Along the middle of the disposal tray 186 is formed a ridge portion 187 so that, as shown in FIG. 16, the heat-developable photo-sensitive material 16 sent from the shaping rollers 70 is stacked with its bent portion at the top of this ridge portions 187.

When this occurs, the heat-developable photo-sensitive material 16 stacked on the ridge portion 187 has both of the bent sides pressed by the pair of pressing bars 84 mounted to the shaft 79, so that the bent portion is held at the top of the ridge.

The following is a description of the operation of this embodiment of the present invention.

As in the first embodiment and the second embodiment, the heat-developable photo-sensitive material 16 and the image-receiving material 32 have transfer performed at the heat-developing and image-transfer part 28 and are then sent to the separation part 42 and separated from each other by the separator arm 60.

The heat-developable photo-sensitive material 16 separated by the separator arm 60 is held and conveyed by a pair of conveyor rollers 66 disposed immediately beneath the separator arm 60. Directly beneath the pair of conveyor rollers 66 is disposed the arc-shaped guide plate 68 and the heat-developable photo-sensitive material 16 is guided by the arc-shaped guide plate 68 and sent to the shaping rollers 70 as bending means.

At the shaping rollers 70, the male roller member 72 and the female roller member 74 receive a drive force and are rotated so as to hold and convey the heat-developable photo-sensitive material 16. When this happens, the heat-developable photo-sensitive material 16 is securely conveyed because the outer periphery of the female roller member 74 is subjected to the knurling process.

The outer periphery of the male roller member 72 is formed with the protruding circular portion 80 while the outer periphery of the female roller member 74 is formed with the recessed circular portion 82, in engagement with each other. Therefore, the heat-developable photo-sensitive material 16 held and conveyed by the male roller member 72 and the female roller member 74 is bent at the middle portion of the width of the same along the direction of the conveyance by the protruding circular portion 80 and the recessed circular portion 82, that is, it is formed with a bead line having a sectional configuration of an inverted "U".

After the heat-developable photo-sensitive material 16 has passed the shaping rollers 70, its rigidity in the direction of conveyance increases because of the bent portion. Irregular waves formed because of the formation of the bead line on the heat-developable photo-sensitive material may extend upstream of the shaping rollers 70. However, because the heat-developable photo-sensitive material 16 is held securely by the pair of conveyor rollers 66, these waves are not transmitted upstream of the conveyor rollers 66 and therefore exert no adverse influence on the conveyance of the heat-developable photo-sensitive material 16.

The heat-developable photo-sensitive material 16 that has been sent from the shaping rollers 70 is stacked in the disposal tray 186. The stacked heat-developable photo-sensitive material 16 on the ridge portion 187 in the disposal tray 186 is pressed and held by the pair of pressing bars 84.

When this happens, the heat-developable photo-sensitive material 16 stacked in the disposal tray 186 is stacked regularly because it has been bent along the direction of the conveyance and halfway across its width, and it is held with the bent portion on the ridge portion 187 and both side portions of the bent portion pressed by the pair of pressing bars 84. Accordingly, there is no increase in the apparent volume of the stacked photo-sensitive material and the space of the disposal tray 186 can be effectively utilized, enabling it to be made more compact.

Also, after stacking, the heat-developable photo-sensitive material 16 is pressed and held by the pair of pressing bars 84, so that curl does not regenerate with the passage of time.

The pair of conveyor rollers 66, the shaping rollers 70 and the disposal tray 186 are disposed immediately after the separation part 42 on the conveyor path for the heat-developable photo-sensitive material 16 and so the conveyor path for the heat-developable photo-sensitive material 16 is very short after the heat-developable photo-sensitive material 16 has been separated from the image-receiving material 32 in the separation part 42. It is therefore possible to use few parts and to reduce the cost, and to eliminate jams because of the increased rigidity due to the bent portion and because both sides of the bent portion are pressed by the pair of pressing bars 84 so that the bent portion is held at the top of the ridge portion 187.

Figure 17:
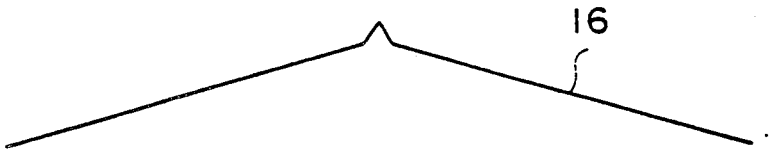
FIG. 17(A) and FIG. 17(B) are sectional views showing alternative shapes of photo-sensitive materials bent.
Figure 17:
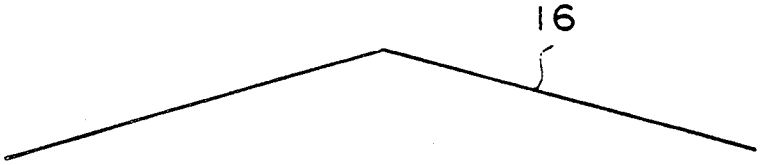

This embodiment of the present invention is configured so that the heat-developable photo-sensitive material 16 is bent in a sectional shape of an inverted "U", i.e., it is formed with a bead line, along the direction of the conveyance and halfway across its width by the protruding circular portion 80 and the recessed circular portion 82 of the shaping rollers 70 (the male roller member 72 and female roller member 74), but a configuration whereby the shapes of the protruding circular portion 80 and the recessed circular portion 82 are changed so that the heat-developable photo-sensitive material 16 is bent in a sectional shape of an inverted "V" along the direction of the conveyance length and halfway across its width can also be alternatively adopted as shown in FIG. 17A, or a configuration wherein the heat-developable photo-sensitive material 16 is simply bent along the distance of the conveyance and halfway across its width as shown in FIG. 17B can also be alternatively adopted.

Figure 18:
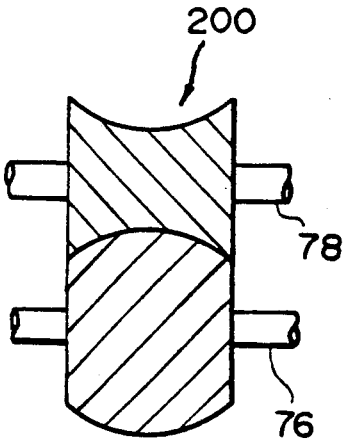
FIG. 18 is a sectional view showing an alternative shape for shaping rollers.

Although in the embodiments described above, a bent portion (or bead line) is formed on the heat-developable photo-sensitive material, it is also possible to use shaping rollers 200 as shown in FIG. 18, to form a bead line having an arc shaped sectional configuration.

As has been described above, the image recording apparatus of this invention provides a simplified structure producing the effect of conveying the heat-developable photo-sensitive material positively and without misfeeding after it has been separated from the image-receiving material, and furthermore, of stacking the heat-developable photo-sensitive material in a small space without waste.

What is claimed is:

1. An image recording apparatus comprising:

means for affixing a photo-sensitive material and an image-receiving material to each other, means for transferring an image recorded on the photo-sensitive material to the image-receiving material, means for separating the photo-sensitive material and the image-receiving material, means for conveying the separated photo-sensitive material, said photo-sensitive material conveying means comprising a plurality of pairs of first rollers operative to convey said material and a pair of second rollers for holding and conveying the photo-sensitive material, disposed at a position where at least the trailing end of the photo-sensitive material can be held by said pair of second rollers while the leading end thereof is held by said pairs of first rollers, said second rollers acting to prevent irregular waves in said material, generated by said first rollers, from progressing upstream of the location of said second rollers; and means for conveying the separated image-receiving material, means for stacking the photo-sensitive material conveyed after separation by said separation means; and means for forming at least one persistent bead line in the photo-sensitive material in the direction of conveyance of the photo-sensitive material while conveying the photo-sensitive material, said bead line forming means being provided with said pairs of first rollers, at least one of said pairs of first rollers being operative to bend the photo-sensitive material and having a first roller formed at its outer periphery with a protruding circular portion, and a second roller formed at the outer periphery with a recessed circular portion, said protruding circular portion being fit into the recessed circular portion whereby the forming of said at least one bead line is carried out by passage of the photosensitive material therebetween.

2. An image recording apparatus according to claim 1, wherein said stacking means comprises a disposal tray for stacking the photo-sensitive material.

3. An image recording apparatus of claim 2, further comprising a pressing means for pressing the photo-sensitive material stacked in said disposal tray.

4. An image recording apparatus according to claim 3, wherein said protruding circular portion and said recessed circular portion of said pair of first rollers are disposed at a position corresponding substantially to the middle of the width of said photo-sensitive material, and said disposal tray has a ridge portion formed at the position corresponding to the bead line formed by said pair of first rollers.

5. An image recording apparatus according to claim 4, wherein said pressing means is provided with a pair of pressing members disposed to press both sides of the portion of the photo-sensitive material corresponding to the bead line.

6. An image recording apparatus according to claim 1, further comprising a pushing means for pushing out the photo-sensitive material from said pair of first rollers by engaging the trailing end of the photo-sensitive material.

7. An image recording apparatus according to claim 6, wherein said pushing means is mounted to at least one of said pair of first rollers to be rotated together with said one of said pair of first rollers, and is provided with a rotating body having an engagement part for engaging the trailing end of said photo-sensitive material.

8. An image recording apparatus according to claim 1, wherein said circular portion of said first roller is rectangularly protruding and said circular portion engaged with said protruding circular portion is a rectangularly recessed portion, such that a bead line of generally inverse "U" shape is formed.

9. An image recording apparatus, comprising:

means for affixing a photo-sensitive material and an image-receiving material to each other, means for transferring an image recorded on the photo-sensitive material to the image-receiving material, means for separating the photo-sensitive material and the image-receiving material to permit them to be conveyed separately, comprising:

a bending means disposed on the downstream side, in the direction of conveyance of the photo-sensitive material, of said separation means, for holding and conveying the photo-sensitive material while bending the photo-sensitive material along a straight line linking the leading and trailing ends of the photo-sensitive material to form at least one, persistent bead line along the direction of conveyance of the photosensitive material said bending means comprising at least one pair of first rollers for bending and conveying the photo-sensitive material, one of said pair of first rollers being formed at its outer periphery with a protruding circular portion, the other being formed at the outer periphery with a recessed portion fitted to said protruding circular portion, second roller means located upstream of said bending means for preventing irregular waves in said material, generated by said bending means, from progressing upstream of said second roller means, and a stacking tray for stacking the bent photo-sensitive material.

10. An image recording apparatus according to claim 9, further comprising a pressing means for pressing and holding the photo-sensitive material stacked in said stacking tray.

11. An image recording apparatus according to claim 10, wherein said protruding circular portion and said recessed circular portion of said pair of first rollers are disposed at a position corresponding substantially to the middle of the width of said photo-sensitive material, and said disposal tray has a ridge portion formed at the position corresponding to the bead line formed by said pair of first rollers.

12. An image recording apparatus of claim 11, wherein said pressing means comprises a pair of pressing bars disposed to press both sides of the portion of the photo-sensitive material corresponding to the bead line.

13. An image recording apparatus according to claim 9, further comprising a forcible discharge means that engages the trailing end of the photo-sensitive material held and conveyed by said pairs of first rollers and discharges the photo-sensitive material forcedly form said pairs of first rollers.

14. An image recording apparatus according to claim 13, wherein said forcible discharge means comprises a rotating body mounted on one of said pair of first rollers to be rotated together with said one of said pair of first rollers and provided with an engagement part for engaging the trailing end of said photo-sensitive material.

15. An image recording apparatus according to claim 14, wherein said engagement part comprises one of cut-away parts and protrusions formed around the outer periphery of the rotating body at equal intervals to define teeth-like structures.

16. An image recording apparatus according to claim 14, wherein said engagement part has grooves and ridges formed alternately around the outer periphery of the rotating body and across its width.

* * * * *